US006308680B1

(12) United States Patent
Prior

(10) Patent No.: US 6,308,680 B1
(45) Date of Patent: Oct. 30, 2001

(54) ENGINE BLOCK CRANKSHAFT BEARINGS

(75) Inventor: Gregory Paul Prior, Birmingham, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/666,322

(22) Filed: Sep. 21, 2000

(51) Int. Cl.[7] ..... F02F 7/00
(52) U.S. Cl. ..... 123/195 R; 123/195 H
(58) Field of Search ..... 123/198 DA, 195 R, 123/195 H, 197.4; 74/595, 596; 384/294, 429, 440, 457

(56) References Cited

U.S. PATENT DOCUMENTS 4,785,772 * 11/1988 Krotky et al. ..... 123/192 B
4,889,435 * 12/1989 Gojon ..... 384/276
4,930,910 * 6/1990 Mori et al. ..... 384/276
5,038,847 * 8/1991 Donahue et al. ..... 164/112
5,129,444 * 7/1992 Bafford ..... 164/112
5,203,854 4/1993 Nilsson et al. ..... 384/433
5,501,529 * 3/1996 Cadle et al. ..... 384/432
5,609,422 * 3/1997 Mueller et al. ..... 384/278
5,816,710 * 10/1998 Warwick et al. ..... 384/433
6,223,713 * 5/2001 Moorman et al. ..... 123/196 R

* cited by examiner

*Primary Examiner*—Noah P. Kamen
*Assistant Examiner*—Hai Huynh
(74) *Attorney, Agent, or Firm*—Leslie C. Hodges; Laura C. Hargitt

(57) ABSTRACT

An internal combustion engine comprises an aluminum alloy engine block housing pistons in cylinders and having a lower face including an upper semi-circular bearing surface. A lower bearing support has a lower semi-circular bearing surface to complement the upper semi-circular bearing surface in the engine block to define a crankshaft bore to rotatably support a ferrous crankshaft. The lower bearing support is formed of a single beryllium-aluminum alloy having a coefficient of thermal expansion comparable to the ferrous crankshaft to promote a consistent clearance between the lower bearing support and the crankshaft. Such a beryllium-aluminum alloy may be comprised of approximately 60–65% by weight beryllium and the balance is aluminum.

9 Claims, 2 Drawing Sheets

ENGINE BLOCK CRANKSHAFT BEARINGS

TECHNICAL FIELD

The present invention relates to bearing supports for a main bearing in an internal combustion engine.

BACKGROUND OF THE INVENTION

Mass reduction is a major goal in engine design. Therefore it is known to substitute aluminum for iron in certain engine components. As a common example, automotive engine blocks may be constructed with all aluminum or other light alloys. One drawback in some applications is that commonly employed aluminum alloys have a much higher coefficient of thermal expansion (CTE) than iron. For example, cast iron has a CTE of about $12\times10^{-6}$/K, whereas 380 aluminum has a CTE of about $21\times10^{-6}$/K, a factor of almost two. Therefore in the case where aluminum bearing caps support a ferrous crankshaft, the aluminum bearing caps thermally grow at a greater rate than the crankshaft as the engine operating temperature increases. This results in an increased bearing clearance and potentially unacceptable bearing life and noise generation. Greater bore clearances require larger capacity lubrication systems to compensate for oil leakage past the main bearings and to maintain adequate oil film thickness on the bearings.

A second drawback in certain applications is that commonly-employed aluminum alloys have a lower elastic modulus and strength relative to ferrous materials. This reduction may cause durability challenges, especially with high bearing loads that are typical with high output, supercharged, and diesel applications.

One solution to the thermal expansion issue, as described in U.S. Pat. No. 5,203,854, is to produce an aluminum bearing support cast with an iron core adjacent to the crankshaft bore to provide comparable coefficients of thermal expansion between the crankshaft and the bearing cap. It is proposed that the bearing clearance does not significantly vary over the range of operating temperatures and therefore noise generation is reduced. The disadvantage is that substituting aluminum with a ferrous insert involves a mass penalty for the engine.

The purpose of the present invention is to provide a main bearing support which has a CTE comparable to the ferrous crankshaft it supports, is more mass efficient than aluminum, and has a greater factor of safety than a ferrous inserted, aluminum support due to lower strains from a higher elastic modulus.

SUMMARY OF THE INVENTION

The present invention is for an internal combustion engine having an aluminum engine block, a ferrous crankshaft, and main bearing supports comprised entirely of a binary alloy of beryllium and aluminum. The beryllium-aluminum alloy has the following material characteristics: low CTE comparable to iron alloy; high strength comparable to iron alloy; and low density compared to iron and aluminum.

For example, beryllium-aluminum alloy with 62% beryllium has a CTE of approximately $14\times10^{-6}$/K, which is comparable to iron alloy. This material selection for the bearing supports ensures that a tighter crankshaft bore tolerance may be maintained as compared to an engine with all aluminum or other light alloy supports through the engine operating temperature range. This is due to comparable thermal rates of expansion of the ferrous crankshaft and beryllium-aluminum bearing supports, which are approximately half as great as that of aluminum. A tighter crankshaft bore tolerance will increase bearing life as there is reduced oil leakage and therefore less wear of the bearings and/or allow for a smaller more efficient oil pump to be used. Further, a tighter bore tolerance may reduce noise generation.

The modulus of beryllium-aluminum is 192 GPa as compared to 69 GPa for aluminum, or 120 GPa for iron. Higher strength bearing supports reduce strain experienced during engine operation and therefore increase the life of the part by reducing stresses due to deflection. To generate equivalent stresses as an iron or aluminum bearing support, a smaller beryllium-aluminum support may be employed, thereby reducing the amount of material required, as the superior modulus compensates for the smaller part. Additionally, the smaller support could provide for improved casting as the parent metal would more fully envelop the support.

The density of 62% beryllium-aluminum alloy is 2.10 g/cm$^3$ as compared to 7.25 g/cm$^3$ for iron, or even 2.71 g/cm$^3$ for aluminum. The low density therefore provides a mass savings over a ferrous inserted aluminum support or even an all aluminum support.

Therefore main bearing supports composed of such a beryllium-aluminum alloy provide a combination of low mass, high strength, and dimensional stability of the crankshaft bore. The relatively high cost of beryllium-aluminum alloy may limit its use to high performance and luxury applications in the near term, but it may have increased commercial applicability with market adjustments.

DESCRIPTION OF THE PREFERRED EMBODIMENT

Figure 1:
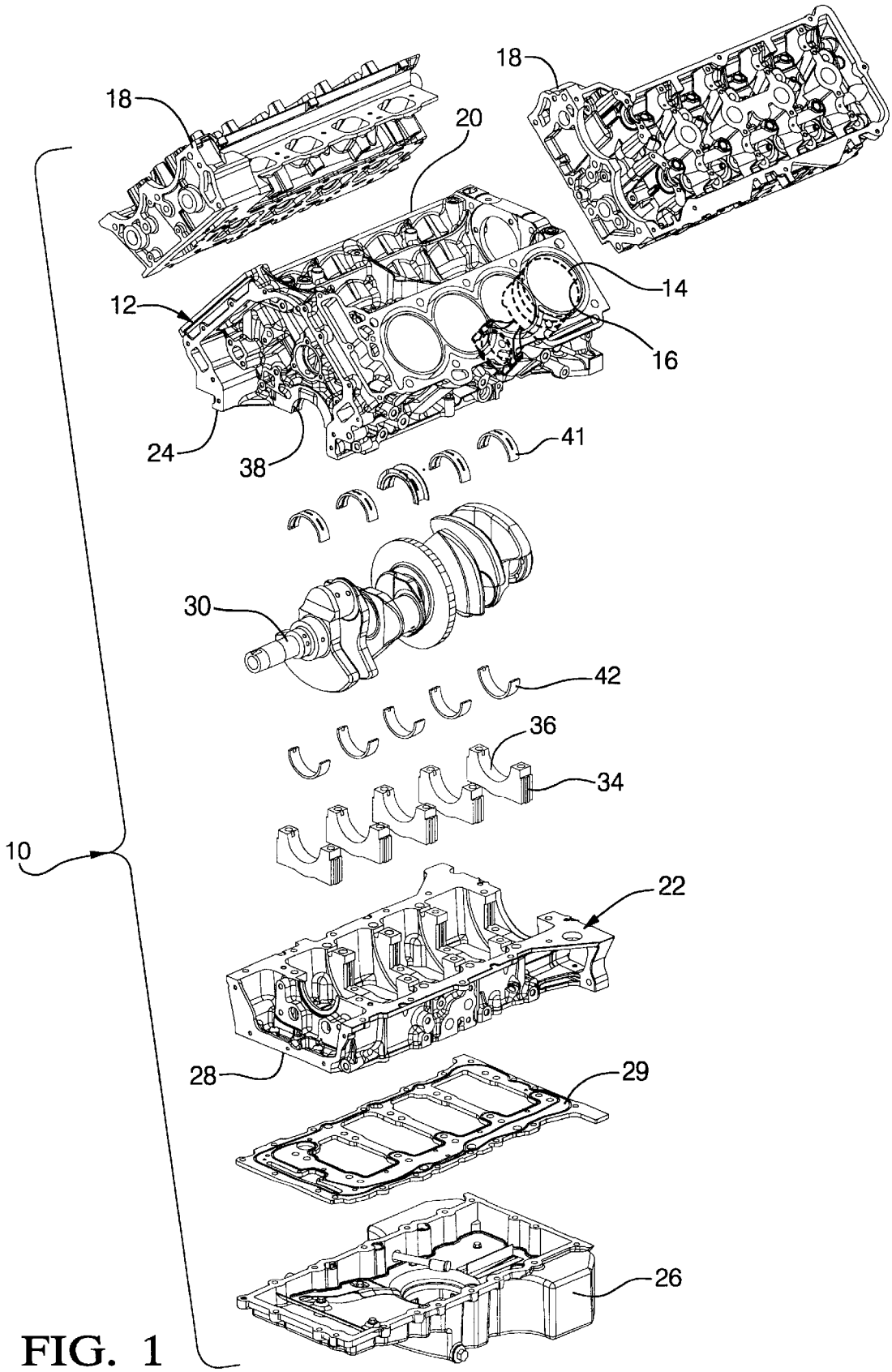
FIG. 1 is an expanded perspective view of an internal combustion engine.

FIG. 1 illustrates an expanded view of an internal combustion engine, shown generally as 10, comprising an engine block 12, housing pistons 14 in cylinders 16. Cylinder heads 18 mate with the upper face 20 of the engine block 12 to close off the cylinders 16. A crankcase 22 bolts to the lower face 24 of the engine block 12, and an oil pan 26 mounts to the lower face 28 of the crankcase 22. An oil manifold 29 is disposed between the crankcase 22 and the oil pan 26.

A crankshaft 30 is housed between the lower face 24 of the engine block 12 and the crankcase 22 and is rotatably supported by bearing supports. A lower bearing support 34 may be provided in the form of a separate, lower insert, which is receivable by the crankcase 22, as shown in FIG. 1, and may be cast integral with the crankcase. Alternatively, the lower bearing support 34 may be bolted to the lower face of the engine block, otherwise known as a bearing cap, not shown.

The lower bearing support 34 includes a lower semi-circular bearing surface 36. The lower face 24 of the engine block 12 includes an upper semi-circular bearing surface 38 to complement the lower semi-circular bearing surface 36 in the lower bearing support 34. Together, the semi-circular bearing surfaces 36, 38 define a crankshaft bore 40 in which upper and lower bushing-type bearings 41 and 42, respectively, support the crankshaft 30.

With regard to material selection, the engine block 12 is die cast of a common aluminum alloy such as 380 aluminum for mass efficiency, whereas the crankshaft 30 is comprised of a ferrous material for strength. The 380 aluminum is primarily aluminum with the following elements: 7.5–9.5% silicon, 3.0–4.0% copper, 3.0% zinc, maximum of 1.3% iron, 0.35% tin, 0.5% manganese, 0.5% nickel, 0.1% magnesium, and 0.5% other.

For mass efficiency, the lower bearing support 34 could also be 380 aluminum, but for the significant difference in coefficients of thermal expansion between 380 aluminum at approximately $21\times10^{-6}$ /K and the ferrous crankshaft at approximately $12\times10^{-6}$/K. This difference may lead to bearing clearances outside of tolerance as the crankshaft and bearing supports thermally expand at different rates. Excess bearing clearance from the bearing support growing away from the crankshaft may cause the oil film to degenerate allowing metal-to-metal contact and reducing bearing life.

Therefore the present invention provides lower bearing supports 34 comprised entirely of a beryllium-aluminum alloy which has a CTE comparable to the ferrous crankshaft 30. Use of this alloy reduces the likelihood of the crankshaft bearing clearance growing beyond the dimensional specification, which in turn reduces the effect of excessive noise generation and oil consumption, and/or bearing life. A nearly constant bearing clearance may be maintained throughout operating temperatures ranging from about −40° C. to 175° C. To achieve the low CTE, the beryllium-aluminum alloy is composed of at least 40% by weight beryllium, and preferably approximately 60–65% by weight beryllium, with aluminum comprising the balance. A beryllium-aluminum alloy with 40% beryllium has a CTE of about $16\times10^{-6}$/K and with 62% beryllium, the CTE is about $14\times10^{-6}$/K. Such a beryllium-aluminum alloy is available from Brush Wellman, Inc. and is designated with the trademark AlBeMet®. AlBeMet® 162 specifies 62% by weight beryllium with aluminum comprising the balance.

The modulus of beryllium-aluminum alloy ranges from about 150 to 200 Gpa, with 62% beryllium having a modulus of 192 GPa as compared to 69 GPa for aluminum, or 120 GPa for iron. Higher strength bearing supports reduce strain experienced during engine operation and therefore increase the life of the part by reducing stresses due to deflection. A smaller size bearing support of beryllium-aluminum may be used due to the greater modulus to achieve equivalent stresses as an aluminum or iron support.

The beryllium-aluminum alloy also provides a mass savings over a ferrous inserted aluminum support or even an all aluminum support. The density may range from about 2.0 to 2.3 g/cm$^3$, with 62% beryllium having a density of 2.10 g/cm$^3$ as compared to 7.25 g/cm$^3$ for iron, or even 2.71 g/cm$^3$ for aluminum.

Figure 2:
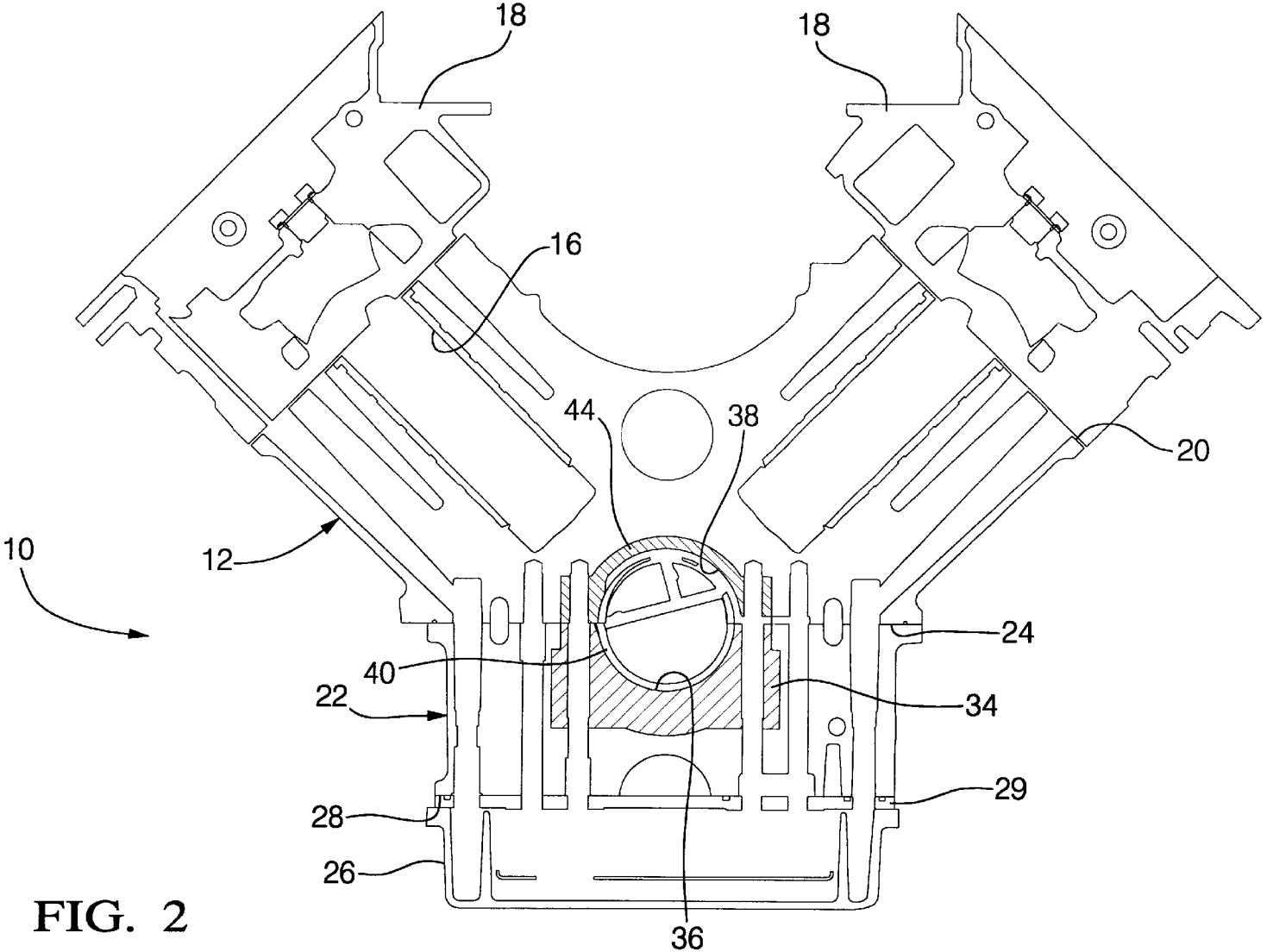
FIG. 2 is a sectional end view of an internal combustion engine including a second configuration of bearing supports of the present invention.

As shown in FIG. 2, the lower bearing support 34 is integrated as part of the crankcase 22, by casting the lower bearing support in as the crankcase is cast. Molten aluminum or other light alloy such as magnesium flows around the beryllium-aluminum bearing support 34. The bearing support 34 is held in position by the shrinking aluminum as the crankcase 22 solidifies, creating a mechanical bond therebetween and perhaps a metallurgical bond between the bearing support and the crankcase. Such a metallurgical bond can not be achieved between a ferrous bearing support and aluminum crankcase; instead only a mechanical bond must be relied on.

Instead of boring the upper bearing surface of the crankshaft bore directly in the engine block 12, an upper bearing support 44 may be used as shown in FIG. 2. Similar to the lower bearing supports 34 discussed above, the upper bearing support 44 may be a separate bearing insert which nests in the engine block 12 or may be cast integral in the block. Where an upper bearing support 44 is used, it is preferable to form it from the same beryllium-aluminum alloy as is used for the lower bearing support 34. This will further provide dimensional stability of the crankshaft bore 40. It may also add strength, but the additional strength is usually not necessary, as the forces of combustion are pushing the crankshaft downward.

The foregoing description of the preferred embodiment of the invention has been presented for the purpose of illustration and description. It is not intended to be exhaustive, nor is it intended to limit the invention to the precise form disclosed. It will be apparent to those skilled in the art that the disclosed embodiment may be modified in light of the above teachings. The embodiment was chosen to provide an illustration of the principles of the invention and its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

What is claimed is:

1. An internal combustion engine, comprising:

an aluminum alloy engine block housing pistons in cylinders and having a lower face including an upper semi-circular bearing surface;

a ferrous crankshaft;

a lower bearing support having a lower semi-circular bearing surface to complement said upper semi-circular bearing surface in said engine block to define a crankshaft bore to rotatably support said ferrous crankshaft and wherein said lower bearing support is entirely formed of a beryllium-aluminum alloy having a coefficient of thermal expansion comparable to said ferrous crankshaft to promote a consistent clearance between said lower bearing support and said crankshaft during engine operation.

2. An internal combustion engine, as defined in claim 1, wherein said beryllium-aluminum alloy bearing support is comprised of at least 40% by weight beryllium.

3. An internal combustion engine, as defined in claim 2, wherein said beryllium-aluminum alloy bearing support is comprised of approximately 60–65% by weight beryllium and the balance is substantially pure aluminum.

4. An internal combustion engine, as defined in claim 3, further comprising a crankcase mounted to said lower face of said engine block and wherein said lower bearing support is cast integral with said crankcase.

5. An internal combustion engine, as defined in claim 2, wherein said beryllium-aluminum alloy bearing support has the following properties (a) a coefficient of thermal expansion of about 13 to $16\times10^{-6}$/K, (b) a modulus of about 150 to 200 GPa, and (c) a density of about 2.0 to 2.3 g/cm$^3$.

6. An internal combustion engine, comprising:

an aluminum alloy engine block housing pistons in cylinders and having a lower face including an upper bearing support having an upper semi-circular bearing surface;

a ferrous crankshaft;

a lower bearing support having a lower semi-circular bearing surface to complement said upper semi-circular bearing surface in said upper bearing support to define a crankshaft bore for rotatably supporting said ferrous crankshaft and wherein said upper and lower bearing supports are formed of a beryllium-aluminum alloy having a coefficient of thermal expansion comparable to said ferrous crankshaft to promote a consistent clearance between said upper and lower bearing supports and said crankshaft.

7. An internal combustion engine, as defined in claim 6, wherein said beryllium-aluminum alloy bearing supports are comprised of at least 40% by weight beryllium.

8. An internal combustion engine, as defined in claim 7, further comprising a crankcase mounted to said lower face of said engine block and wherein said lower bearing support is cast integral with said crankcase.

9. An internal combustion engine, as defined in claim 8, wherein said upper bearing support is cast integral with said engine block.

* * * * *